US012325941B2

(12) United States Patent
Davis

(10) Patent No.: US 12,325,941 B2
(45) Date of Patent: Jun. 10, 2025

(54) SEWING AND KNITTING NEEDLE

(71) Applicant: Saundria Davis, Cleveland, OH (US)

(72) Inventor: Saundria Davis, Cleveland, OH (US)

( * ) Notice: Subject to any disclaimer, the term of this patent is extended or adjusted under 35 U.S.C. 154(b) by 98 days.

(21) Appl. No.: 18/203,329

(22) Filed: May 30, 2023

(65) Prior Publication Data

US 2023/0323580 A1 Oct. 12, 2023

Related U.S. Application Data

(63) Continuation-in-part of application No. 29/775,549, filed on Mar. 24, 2021, now abandoned.

(51) Int. Cl.

| | |
|---|---|
| ***D05B 85/06*** | (2006.01) |
| ***D04B 3/02*** | (2006.01) |
| ***D05B 85/12*** | (2006.01) |

(52) U.S. Cl.

CPC ..... *D05B 85/06* (2013.01); *D04B 3/02* (2013.01); *D05B 85/12* (2013.01); *D05D 2209/12* (2013.01)

(58) Field of Classification Search

CPC . D05B 5/06; D05B 5/00; D05B 5/006; D05B 5/04; D05B 5/10; D05B 5/12; D05B 5/14; D05B 85/12; D05B 3/02; D05D 2209/12

See application file for complete search history.

(56) References Cited

U.S. PATENT DOCUMENTS

| | | | | | |
|---|---|---|---|---|---|
| 847,452 | A * | 3/1907 | Ascue | D05B 81/00 | 223/104 |
| 3,307,376 | A * | 3/1967 | Seiler | D04B 35/04 | 66/70 |
| 5,041,127 | A * | 8/1991 | Troutman | A61B 17/06066 | 223/102 |
| 5,059,207 | A * | 10/1991 | Shah | A61B 17/06066 | 223/102 |
| 5,433,728 | A * | 7/1995 | Kim | A61B 17/06066 | 606/205 |
| 2015/0315734 | A1* | 11/2015 | Cho | D05B 85/06 | 223/102 |
| 2020/0268378 | A1* | 8/2020 | Cichocki, Jr. | A61B 17/06066 | |

FOREIGN PATENT DOCUMENTS

| | | | | |
|---|---|---|---|---|
| DE | 202011105722 U1 * | 12/2011 | | D04B 3/02 |
| DE | 202017001294 U1 * | 6/2017 | | D04B 3/02 |

* cited by examiner

*Primary Examiner* — Ismael Izaguirre
(74) *Attorney, Agent, or Firm* — Daniel M. Cohn; Howard M. Cohn

(57) ABSTRACT

A hand sewing and knitting needle comprises an elongate body having a first end section extending from a first end to a middle section. The elongate body having a second end section beginning at the middle section and extending to the second end of the second end section. The middle section extending from a second end of the first end section to the first end of the second end section.

17 Claims, 1 Drawing Sheet

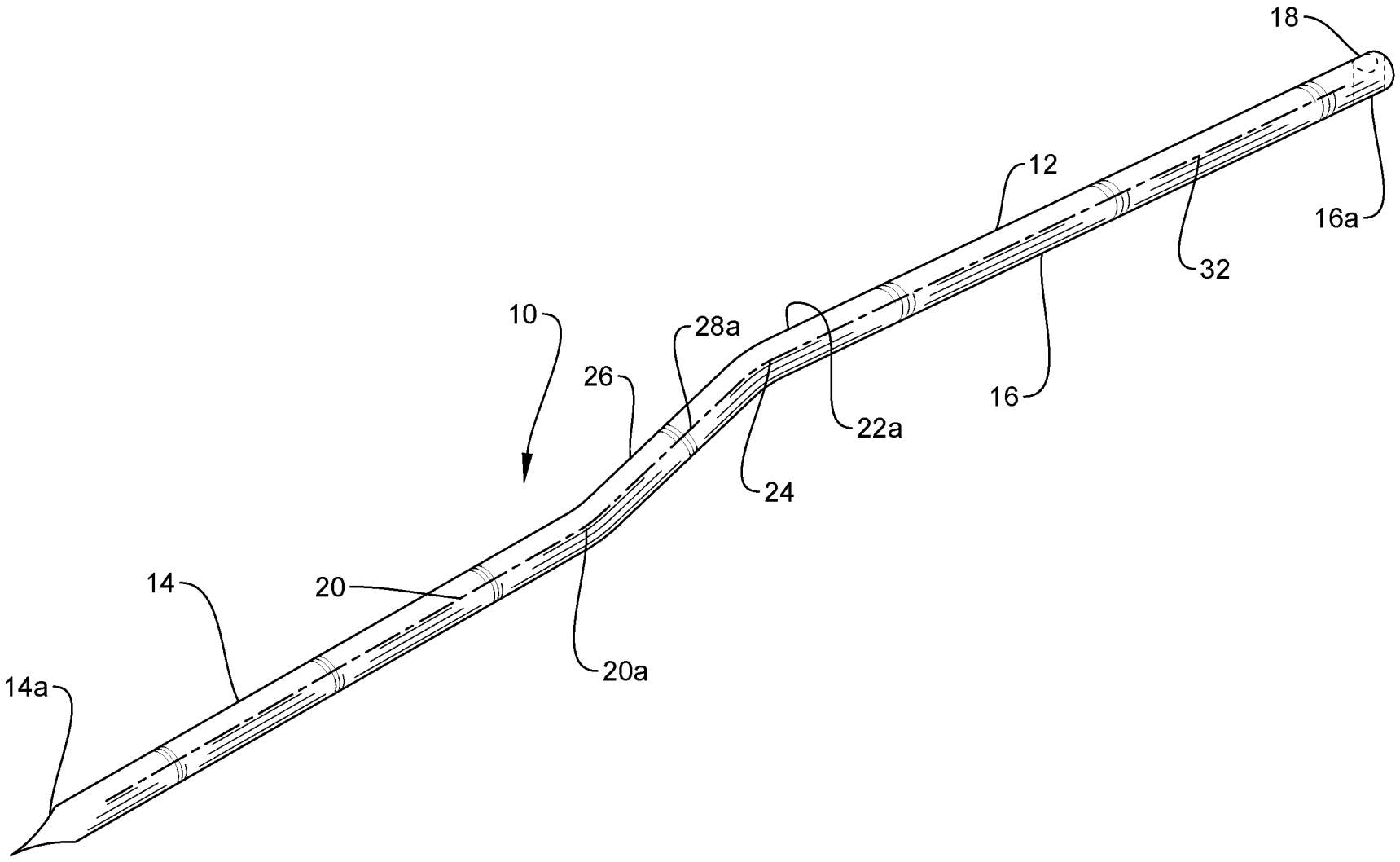
18
16a
32
12
16
22a
24
28a
26
20a
10
20
14
14a

SEWING AND KNITTING NEEDLE

CROSS-REFERENCE TO RELATED APPLICATIONS

This application claims the benefit of U.S. patent application Ser. No. 29/775,549 filed on Mar. 24, 2021, which is incorporated in its entirety herein by reference.

TECHNICAL FIELD OF THE INVENTION

The invention relates to a sewing and kitting needle and more particularly to a sewing needle that needle is easier and more comfortable to grip for better control and detailing speed.

BACKGROUND OF THE INVENTION

Sewing needles have been in use for years. Typically, a conventional hand sewing needle has a body with a pointed end and an eyelet attached to the body opposite of the pointed end. The user attaches a length of thread within the eyelet and then grasps the body near the eyelet. The user inserts the thread the pointed end of the conventional hand-sewing needle through the fabric until the eyelet is drawn through the opposite side of the fabric. The user must then rotate the conventional needle 180 degrees so that the pointed end faces the opposite side of the fabric thereby allowing the user to manually insert the conventional needle from the opposite side of the fabric.

The main problem with conventional hand sewing needles is that they require the user to rotate the conventional hand sewing needle 180 degrees each time it is inserted through the fabric to sew a stitch. This increases the time required to complete a sewing job. Rotating the conventional hand sewing needle also requires the user to position their hands in awkward positions that can eventually cause injuries to the user's hands and wrists.

While these devices may be suitable for the particular purpose to which they address, they are not as suitable for eliminating the requirement of turning the hand sewing needle after each pass through a piece of fabric. Conventional hand sewing needles require the user to rotate the body of the needle 180 degrees after each insertion of the conventional needle.

SUMMARY OF THE PRESENT INVENTION

A hand sewing and knitting needle, comprising an elongate body having a first end section extending from a first end to a middle section. The elongate body has a second end section beginning at the middle section and extending to the second end of the second end section. The middle section begins at a second end of the first end section and the middle section ends at the first end of the second end section.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

FIG. 1 is a prospective view of a sewing and knitting needle, comprising an elongated body having a pointed tip at one end and an eyelet at a second end, according to the invention.

DETAILED DESCRIPTION OF THE PREFERRED EMBODIMENTS

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader and should not in any way be interpreted as limiting.

FIG. 1 illustrates a hand sewing and knitting needle 10, which comprises an elongate body 12 having a first end section 14 extending from a first end 14*a* to a middle section 26 and a second end section 16 beginning at the middle section 26 to the end 16*a* of the second section 16. An eyelet 18 is positioned within the elongate body 12 for receiving a length of thread 20 wherein the eyelet 18 is disposed at the second end 16*a* of the elongate body 12. The first end 14 of the elongate body 12 may be comprised of any well-known structure such as pointed end and the second end of the elongate body 12 may be comprised of any well-known structure such as a blunt end.

As best shown in FIG. 1 of the drawings, the elongate body 12 is preferably cylindrical in shape. It can be appreciated by one skilled in the art that the elongate body 12 may have various cross-sectional shapes such as circular, square, oval, rectangular and other well-known shapes. The elongate body 12 is preferably formed with two straight axes 20 and 22 through the first end section 14 and second end section 16, respectively, separated by a curved axis 28 through the central or middle 26 wherein the curved axis is adjoined to the ends 20*a* and 22*a* of the two straight axes 20 and 22. The curved axis 28 can start at one end 20*a* of axis 20 and bend upwards at an angle of between 25 and 60 degrees to the center 28*a* of the curved axis through the mid-section 26. Then, beginning at the center 28*a* of the curved axis 28, the curved axis can bend downward at an angle of between 25 and 60 degrees to the end 22*a* of the axis 22 through the middle of the second end section 16.

The elongate body 12 may be solid in structure or may be comprised of a hollow structure. The elongate body 12 is preferably comprised of a metal such as carbon steel that may be copper-plated and nickel-plated. It can be appreciated that the elongate body 12 may be comprised of any common material such as metal or plastic.

As shown in FIG. 1, the hand sewing and knitting needle 10 also known as the universal, hand sewing, and weaving knitting needle has a top and bottom, 20 and 22, also shown as left and right side, each having the same gauge. While each end 14 and 16 of the needle 10 is straight, the top end 14 has aa point and the bottom end 16 is blunt.

The needle comes in a varied range of different lengths and thickness. The materials of the needle can be aluminum or high carbon steel wire nickel or 18 K gold plated wire for corrosion resistance. Also because of the very thin, half inch gauge, double bend in the middle section 26, the bottom left and the right side of the needle create a palindrome that is the same on either side of the middle section whereby the needle is balanced on either side and at all angles.

The result is that the needle is easier and more comfortable to grip for better control and detailing speed when the needle has a point on one end 14 and a hole 18 on the opposite end even without a point on the opposite end. When using the needle 10, the knitter will have an advantage causing them to not need other devices and attachments to create patterns. The knitter can formulate their pattern by dispensing the yarn through the hole 18.

The needle 10 can be used to make jewelry because of the gauge, a half inch slight double bend in the middle of the needle and the top and bottom, right and left angles gives the knitter the ability to control the needle and also to bead the thread for a project and for anyone using the needle.

Below is a size chart for the needle 10.

| Size | Length Mm | Diameter mm | Diameter Thousandths of an inch |
|---|---|---|---|
| 1 | 48.5 | 1.02 | 0.040 |
| 2 | 44 | 0.86 | 0.034 |
| 3 | 40 | 0.76 | 0.034 |
| 4 | 37 | 0.69 | 0.027 |
| 5 | 34 | 0.61 | 0.024 |
| 6 | 32.5 | 0.53 | 0.021 |
| 7 | 31 | 0.46 | 0.018 |
| 8 | 29.5 | 0.41 | 0.016 |

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A hand sewing and knitting needle, comprising:

a solid, elongated body having a first end section extending from a first end of the first end section to a second end of the first end section, the second end of the first end section adjoining a first end of a middle section;

the elongated body having a second end section beginning at a second end of the middle section and extending to a second end of the second end section;

the middle section extending from a second end of the first end section to a first end of the second end section;

the elongated body is formed with first and second straight axes through the first end section and the second end section, respectively;

the first and second straight axes each having an inner end;

the first and second straight axes being offset from each other; and the first and second straight axes being interconnected by a third axis extending through the middle section wherein the third axis is straight in middle of the middle section and has first and second slight curved portions at either end of the middle section adjoined to the inner ends of the two straight axes.

2. The hand sewing and knitting needle of claim 1 wherein an eyelet is positioned within the elongated body receiving a length of thread.

3. The hand sewing and knitting needle of claim 2 wherein the eyelet is disposed at the second end of the elongated body.

4. The hand sewing and knitting needle of claim 3 wherein the first end of the elongated body is a pointed structure.

5. The hand sewing and knitting needle of claim 4 wherein the second end of the elongated body is a blunt end.

6. The hand sewing and knitting needle of claim 3 wherein the elongated body has a cylindrical cross-sectional shape.

7. The hand sewing and knitting needle of claim 3 wherein the elongated body has a cross-sectional shape selected from the group consisting of circular, square, oval, and rectangular shapes.

8. The band sewing and knitting needle of claim 1 wherein the first slight curved portion of the middle axis starts at the inner end of the first straight axis and bends upwards at an angle of between 25 and 60 degrees to a third axis extending through the middle of the middle section.

9. The hand sewing and knitting needle of claim 8 wherein the second slight curved portion bends downward at an angle of between 25 and 60 degrees from the inner end of the second straight axis disposed in the second end section.

10. The band sewing and knitting needle of claim 9 wherein the elongated body is solid in structure.

11. The hand sewing and knitting needle of claim 9 wherein the elongated body is hollow in structure.

12. The hand sewing and knitting needle of claim 9 wherein the elongated body is comprised of plastic.

13. The hand sewing and knitting needle of claim 9 wherein the elongated body is comprised of metal.

14. The hand sewing and knitting needle of claim 13 wherein the elongated body is comprised of metal plated with a plating selected from the group comprising copper-plated, gold plated and nickel-plated.

15. The hand sewing and knitting needle of claim 13 wherein the elongated body comes in a range of different lengths and thickness.

16. The band sewing and knitting needle of claim 14 wherein the elongated body is constructed of a material selected from the group comprising aluminum, nickel plated high carbon steel wire and 18 K gold plated high carbon steel wire for corrosion resistance.

17. The hand sewing and knitting needle of claim 9 wherein the elongated body is very thin, half inch gauge, with two slight curved bends on either side in the middle section; and the elongated body having a bottom left and a right side to create a palindrome that is the same on either side of the middle section whereby the elongated body is balanced on either side and at all angles.

* * * * *